US012269673B2

(12) United States Patent
Schliwa et al.

(10) Patent No.: US 12,269,673 B2
(45) Date of Patent: Apr. 8, 2025

(54) FREIGHT CONTAINER INTENDED TO BE RECEIVED IN THE CARGO HOLD OF AN AIRCRAFT

(71) Applicant: Airbus Operations GmbH, Hamburg (DE)

(72) Inventors: Ralf Schliwa, Hamburg (DE); Thomas Grabow, Hamburg (DE); Hermann Benthien, Hamburg (DE); Lars Uwe Hansen, Hamburg (DE); Dirk Meiranke, Hamburg (DE); Lucas Gleixner, Hamburg (DE); Paul Wichtmann, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 162 days.

(21) Appl. No.: 17/919,041

(22) PCT Filed: Apr. 13, 2021

(86) PCT No.: PCT/EP2021/059586

§ 371 (c)(1),
(2) Date: Oct. 14, 2022

(87) PCT Pub. No.: WO2021/209464

PCT Pub. Date: Oct. 21, 2021

(65) Prior Publication Data

US 2023/0234776 A1 Jul. 27, 2023

(30) Foreign Application Priority Data

Apr. 17, 2020 (DE) ..... 102020110562.2

(51) Int. Cl.
*B65D 88/14* (2006.01)

(52) U.S. Cl.
CPC ..... *B65D 88/14* (2013.01)

(58) Field of Classification Search
CPC ..... B65D 88/14; B65D 88/02; B65D 88/12
See application file for complete search history.

(56) References Cited

U.S. PATENT DOCUMENTS 4,428,491 A 1/1984 Mittelmann et al.
4,799,600 A 1/1989 Gunn et al.
(Continued)

FOREIGN PATENT DOCUMENTS

DE 3024410 A1 1/1982
DE 102010019162 A1 11/2011
WO 2008118077 A1 10/2008

OTHER PUBLICATIONS

International Search Report and Written Opinion dated Jun. 29, 2021; priority document.
German Search Report dated Oct. 30, 2020; priority document.

*Primary Examiner* — Anthony D Stashick
*Assistant Examiner* — Blaine G Neway
(74) *Attorney, Agent, or Firm* — Greer, Burns & Crain, Ltd.

(57) ABSTRACT

A freight container configured to fit in an aircraft cargo hold includes a floor element. First and second parallel side walls extend away from first and second opposite edges of the floor element base surface. A top wall, parallel to a floor element resting surface, extends between edges of the first and second side walls, which edges are remote from the first and second edges. A front wall extends between the first and second side walls from a base surface third edge to a top wall front edge. The front wall has a first front wall portion, extending from the base surface third edge at a first angle of at least 90° to the resting surface. The front wall has a second front wall portion, extending from the top wall front edge at a second angle of less than 180° and more than 90° to the top wall.

14 Claims, 2 Drawing Sheets

(56) References Cited

U.S. PATENT DOCUMENTS

| | | | | |
|---|---|---|---|---|
| 4,923,076 | A * | 5/1990 | Weiss | B65D 88/14<br>220/668 |
| 4,936,477 | A * | 6/1990 | King | B65D 90/021<br>52/204.591 |
| 6,691,952 | B2 * | 2/2004 | Keogh | B64D 11/00<br>5/118 |
| 10,773,881 | B2 * | 9/2020 | Pherson et al. | B65D 90/22 |
| 2010/0243647 | A1 | 9/2010 | Nordstrom | |
| 2014/0367220 | A1 * | 12/2014 | Lange | B64D 11/04<br>198/347.2 |

* cited by examiner

FREIGHT CONTAINER INTENDED TO BE RECEIVED IN THE CARGO HOLD OF AN AIRCRAFT

CROSS-REFERENCES TO RELATED APPLICATIONS

This application claims the benefit of the International Application No. PCT/EP2021/059586, filed on Apr. 13, 2021, and of the German patent application No. 102020110562.2 filed on Apr. 17, 2020, the entire disclosures of which are incorporated herein by way of reference.

FIELD OF THE INVENTION

The present invention relates to a freight container intended to be received in the hold of an aircraft.

BACKGROUND OF THE INVENTION

It is known from the prior art that the hold of an aircraft is loaded in such a manner that individual freight elements are loaded into so-called freight containers, the freight containers having a bottom element which can bear on the bottom of the hold and having a wall which is formed from dimensionally stable material such as aluminum. The freight containers are conveyed into the hold through an entrance or a loading hatch, wherein, for this purpose, use is made of a conveying device, such as for example a conveyor belt, which runs at an angle in relation to the plane of the maneuvering area on which the aircraft stands and also at an angle to the plane of the bottom of the hold.

The result, in turn, of this is that the freight container firstly passes into the entrance of the hold inclined at the angle and, when it is already situated to a certain extent in the interior of the hold, pivots toward the plane of the bottom of the hold, before then being conveyed further into the hold.

Conventional containers are configured in such a way that the front wall, which, during the transport of the freight container, faces toward the loading hatch and is moved through the latter first of all, is configured in such a way that it includes an angle of 90° with the top wall of the freight container, which forms the upper side thereof. The result of this is that when the freight container is moved in an inclined manner into the hold through the loading hatch, its upper, front end can come into contact with the top of the hold if the distance of the top wall from the bottom element is too large.

In order for damage to the top of the hold by the top wall of the freight container to be avoided, it is therefore the case that the height of the top wall above the bottom element is limited to a predefined height, which limits the receiving volume of the freight container.

SUMMARY OF THE INVENTION

Therefore, proceeding from the prior art, it is an object of the present invention for a freight container used for loading of the hold of an aircraft to be configured in such a way that it has as large a receiving volume as possible and can still enter the interior of the hold of an aircraft in an inclined manner without the front end coming into contact with the top of the hold.

This object is achieved by a freight container intended to be received in the hold of an aircraft, having a bottom element which has a bearing surface which is configured to bear on a bottom surface of a hold of an aircraft, wherein the bottom element has a rectangular base surface which is arranged on that side of the bottom element which faces away from the bearing surface, wherein the base surface preferably extends parallel to the bearing surface.

In this case, the base surface forms the bottom side of the receiving space of the freight container, on which bottom side the freight elements which are received in the freight container bear. Preferably, the base surface is of planar configuration and extends parallel to the bearing surface by way of which the freight container bears on the bottom of the hold. It is however also possible for the base surface to have a curved profile or to extend in an inclined manner in relation to the bearing surface.

In the freight container according to the invention, a first and a second side wall extend away from mutually opposite first and second edges of the base surface, wherein the first and second side walls extend in planes which are spaced apart from one another. In a preferred embodiment, the side walls extend in planes which extend perpendicularly to the bearing surface since, then, two freight containers can be arranged as close to one another as possible. It is however also possible for the side walls to extend in planes which are inclined relative to the bearing surface and away from one another.

Between edges, remote from the first and second edges, of the first and second side walls, provision is made of a top wall which extends parallel to the bearing surface. The top wall forms the upper side of the freight container, and those edges of the side walls between which the top wall extends extend in a plane which extends parallel to the bearing surface.

The freight container according to the invention furthermore has a front wall between the first and second side walls, which extends from a third edge of the base surface to a front edge of the top wall, wherein the third edge connects the first and second edges to one another. Both the third edge, as seen in the plane of the bearing surface, and the front edge, as seen in the plane of the top wall, face in the same direction.

According to the invention, the front wall is formed in such a way that it has a first front-wall portion which extends from the third edge of the base surface at a first angle of at least 90° relative to the bearing surface between the first and second side walls. The front wall furthermore has a second front-wall portion which extends from the front edge of the top wall at a second angle of less than 180° and greater than 90° to the top wall.

Finally, the freight container according to the invention is provided with a rear wall which extends between the first and second side walls from a fourth edge of the base surface to a rear edge of the top wall, wherein the fourth edge connects the first and second edges to one another, and wherein the fourth edge, as seen in the plane of the base surface, and the rear edge, as seen in the plane of the top wall, face in the same direction.

In the case of the freight container according to the invention, the side walls, the top wall, the front wall and the rear wall enclose the receiving space for the freight elements, which receiving space extends upward away from the base surface on the bottom element. However, the front wall does not extend in such a manner that it meets the top wall at an angle of 90°. Rather, according to the invention, it is the case that the front wall has a second front-wall portion which extends away from the top wall at the second angle of greater than 90° and less than 180°. Preferably, this angle is greater than 120°. The angle is particularly preferably 135°. Consequently, the second front-wall portion extends downward in an inclined manner. In particular, the second angle may be selected in such a way that it corresponds to 180° minus the angle which the conveyor belt, by which the freight container is conveyed into the hold, is at relative to the horizontal. This is associated with the advantage that if the freight container according to the invention is conveyed into the hold of an aircraft by means of the inclined conveyor belt, the front portion is moved with the second front-wall portion toward the top of the hold. Due to the inclined profile of the front-wall portion, the inclined freight container can, however, be conveyed further into the hold than would be the case if the top wall were to extend as far as the frontmost end of the freight container in the plane thereof. In the configuration according to the invention, it is still possible, in a hold, with a predefined height, for the top wall to be arranged, remote from the frontmost end of the freight container, at a greater distance from the bearing surface than would be the case if the top wall were to extend in a single plane as far as the frontmost end. It is thus possible for the receiving volume of the freight container to be increased in comparison with this conventional design.

In a preferred embodiment, the freight container is configured in such a way that the first angle, at which the first front-wall portion extends to the front and/or upward from the base surface, is greater than 90° and is preferably at least 135°. This has the advantage that, if the front wall faces a side wall of the hold, the freight container is matched to the profile of the side wall of the hold.

In a further preferred embodiment, between the first front-wall portion and the second front-wall portion, provision may be made of a third front-wall portion which connects the first front-wall portion to the second front-wall portion, wherein the third front-wall portion preferably extends at an angle of 90° to the bearing surface. In this way, an acute angle is not formed between the first and second front-wall portions and the freight container can likewise be loaded effectively in the region of the front wall.

Furthermore, in a preferred embodiment, the freight container according to the invention may be configured in such a way that the rear wall has a first rear-wall portion which extends from a fourth edge of the base surface at a third angle of greater than 90° to the bearing surface between the first and second side walls, wherein the third angle is furthermore preferably at least 135°. In this embodiment, the receiving space extends beyond the surface predefined by the base surface, and the receiving volume is further increased.

It is furthermore preferable for the rear wall to have a second rear-wall portion which extends from the rear edge of the top wall at a fourth angle of less than 180°, preferably of 90°, to the top wall, wherein it is particularly preferable for the first and second rear-wall portions to be connected directly to one another.

In an alternative embodiment, it is also possible for the freight container to be configured in such a way that the rear wall extends from the fourth wall of the base surface toward the rear edge of the top wall at an angle of 90°. Such a configuration is advantageous if the hold of an aircraft is of such a width that two freight containers can be received next to one another "back-to-back" in the hold of an aircraft. Then, in this configuration, as little stowage space as possible is wasted.

Furthermore, it is preferable for the freight container to have, along the edge of the first and/or of the second side wall, fastening devices for connection to freight-compartment fastening elements. In particular, the fastening devices may be provided on an edge between the first and/or the second side wall and the first front-wall portion and on an edge between the first and/or the second side wall and the first rear-wall portion. In this way, the freight container can be secured in the hold.

BRIEF DESCRIPTION OF THE DRAWINGS

The present invention will be discussed below on the basis of a drawing showing merely preferred exemplary embodiments, in which.

DETAILED DESCRIPTION OF THE PREFERRED EMBODIMENTS

Figure 1:
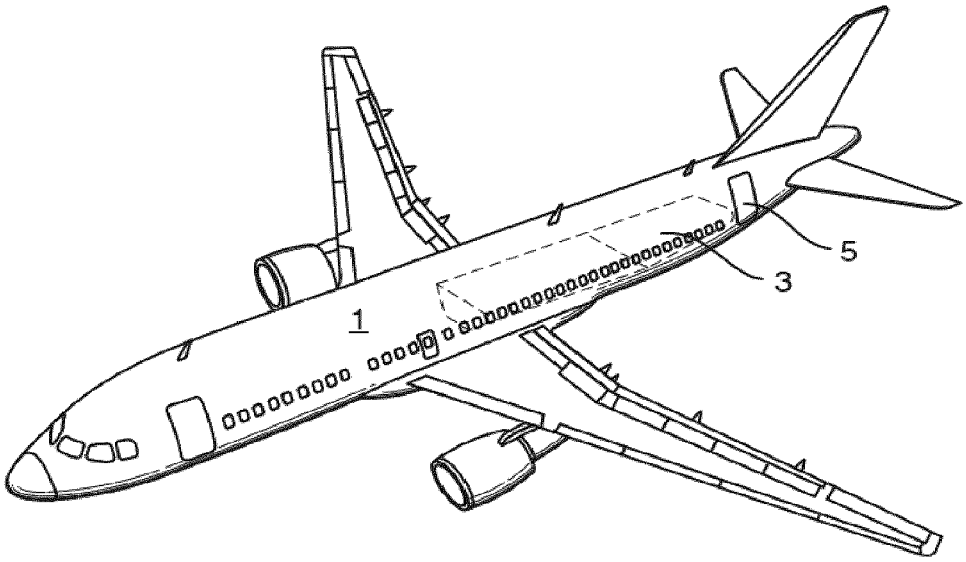
FIG. 1 shows a perspective illustration of an aircraft with a hold for receiving freight containers.

FIG. 1 shows an aircraft 1 whose hold 3 can be loaded through the loading hatch 5 with freight containers 7 according to the first and second exemplary embodiments.

Figure 2:
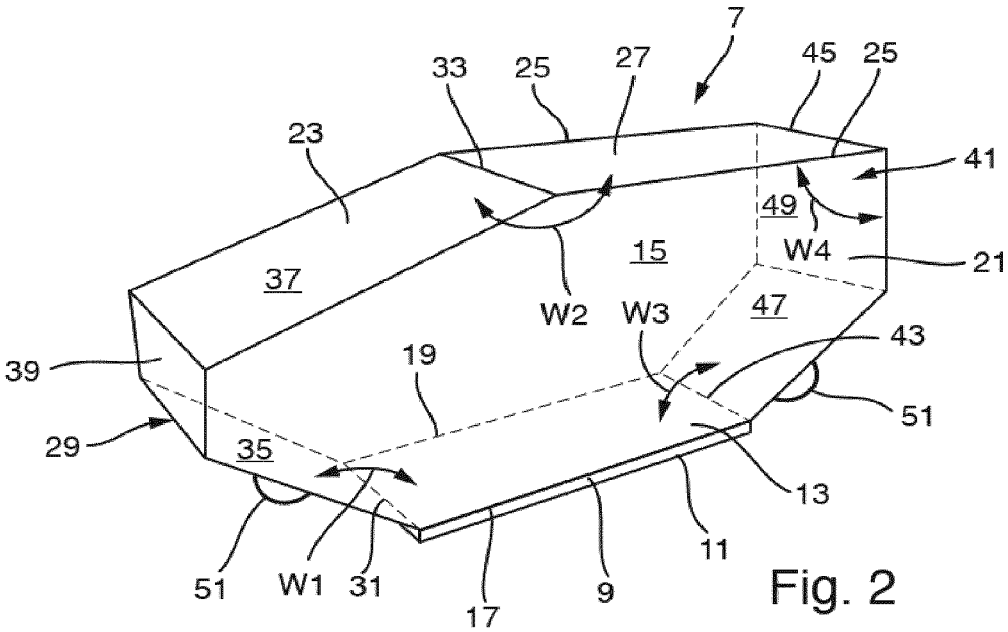
FIG. 2 shows a first exemplary embodiment of a freight container according to the invention in a perspective illustration.

The first exemplary embodiment, shown in FIG. 2, of a freight container 7 according to the invention has a bottom element 9 which, in turn, has a bearing surface 11 which is configured to bear on a bottom surface of a hold 3 of an aircraft 1. The bottom element 9, furthermore, has a rectangular base surface 13 which is arranged on that side of the bottom element 9 which faces away from the bearing surface 11, that is to say, the base surface 13 faces away from the bottom surface on which the freight container 7 may be arranged. Furthermore, in the exemplary embodiment shown here, the base surface 13 is of planar configuration and extends parallel to the bearing surface 11.

In this case, the base surface 13 forms the bottom side of the receiving space 15 of the freight container 7, on which bottom side the freight elements which are received in the freight container 7 bear. In the case of the freight container 7 according to the invention, a first side wall 21 and a second side wall 23 extend away from mutually opposite first and second edges 17, 19 of the base surface 13. In this case, the first and second side walls 21, 23 extend in planes which are spaced apart from one another, and the side walls 21, 23 moreover extend perpendicularly to the bearing surface 11. It is however also possible for the side walls 21, 23 to extend in planes which are inclined relative to the bearing surface 11 and away from one another.

Between the side walls 21, 23 and on edges 25 thereof that are remote from the first and second edges 17, 19, provision is made of a top wall 27 which extends parallel to the bearing surface 11. Thus, the top wall 27 constitutes the upper side of the freight container 7, and those edges 25 of the side walls 21, 23 on which the top wall is provided extend in a plane which extends parallel to the bearing surface 11 and also parallel to the base surface 13.

The exemplary embodiment of a freight container 7 according to the invention from FIG. 2 furthermore has a front wall 29 which is provided between the first and second side walls 21, 23. The front wall 29 extends from a third edge 31 of the base surface 13 or of the bottom element 9 to a front edge 33 of the top wall 27. In this case, the front wall 29 has a first front-wall portion 35, a second front-wall portion 37 and a third front-wall portion 39, which are arranged in a manner described in more detail.

The third edge 31, from which the front wall 29 extends, connects the first and second edges 17, 19 to one another, wherein both the third edge 31, as seen in the plane of the bearing surface 11 or of the base surface 13, and the front edge 33, as seen in the plane of the top wall 27, face in the same direction, namely toward the front.

In the exemplary embodiment according to the invention of a freight container 7, the front wall 29 is formed in such a way that it has a first front-wall portion 35 which extends away from the third edge 31 of the base surface 13, and thus of the bottom element 9, at a first angle W1 of at least 90° to the bearing surface 11 between the first and second side walls 21, 23. In the exemplary embodiment described here, the first angle W1 is 135°. It is however also possible for the first angle W1 to be greater than 135°.

The front wall 29 furthermore has a second front-wall portion 37 which extends from the front edge 33 of the top wall 27 at a second angle W2 of less than 180° and greater than 90° to the top wall 27. In the exemplary embodiment described here, the second angle W2 is 135°. Other angles are however also conceivable. The second angle W2 may be selected, in particular, in such a way that it is 180° minus the angle at which a conveyor belt, by which the freight container 7 is conveyed into the loading compartment 3 of the aircraft 1, is inclined to with respect to the horizontal.

Finally, between the first front-wall portion 35 and the second front-wall portion 37, provision is made of a third front-wall portion 39 which connects the first front-wall portion 35 to the second front-wall portion 37, wherein the third front-wall portion 90 extends here at an angle of 90° to the bearing surface 11. In this way, an acute angle is not formed between the first and second front-wall portions 35, 37 and the freight container 7 can be loaded effectively in the region of the front wall 29.

The freight container 7 as per FIG. 2 is moreover provided with a rear wall 41 which extends between the first and second side walls 21, 23 from a fourth edge 43 of the base surface 13, and thus of the bottom element 9, to a rear edge 45 of the top wall 27, wherein the fourth edge 43 connects the first and second edges 17, 19 to one another, and wherein the fourth edge 43, as seen in the plane of the bearing surface 11 or of the base surface 13, and the rear edge 45, as seen in the plane of the top wall 27, face in the same direction.

In the exemplary embodiment from FIG. 2, the rear wall 41 of the freight container 7 has a first rear-wall portion 47 which extends from the fourth edge 43 of the base surface at a third angle W3 of greater than 90° to the bearing surface 11 and the base surface 13 between the first and second side walls 21, 23. In the exemplary embodiment described here, this third angle W3 is 135°, so that, in this embodiment, the receiving space 15 extends beyond the third and fourth edges 31, 43 of the base surface. The rear wall 41 furthermore has a second rear-wall portion 49 which extends from the rear edge 45 of the top wall 27 at a fourth angle W4 of less than 180° and, in this case, 90° to the top wall 27. In this case, the first and second rear-wall portions 47, 49 are connected directly to one another and thereby jointly form the rear wall 41 between the bottom element 9 and the top wall 27.

Finally, the freight container 7 has, along the edge of the first and/or of the second side wall, fastening devices for connection to freight-compartment fastening elements. In this case, the fastening devices, in this case in the form of eyelets 51, are provided on an edge between the first side wall 21 and the first front-wall portion 35 and on an edge between the first side wall 21 and the first rear-wall portion 47.

In the case of the freight container 7 according to the invention, the side walls 21, 23, the top wall 27, the front wall 29 and the rear wall 41 enclose the receiving space 15 for the freight elements, which receiving space extends upward away from the base surface 13 on the bottom element 9. However, the front wall 29 does not extend in such a manner that it meets the top wall 27 at an angle of 90°. Rather, in the exemplary embodiment according to the invention, it is the case that the front wall 29 has the second front-wall portion 37 which extends away from the top wall 27 at the second angle W2 of, in this case, 135°. Consequently, the second front-wall portion 37 extends downward in an inclined manner.

If the freight container 7 is then conveyed into the hold 3 of an aircraft 1 by means of an inclined conveyor belt, the front portion of the freight container 7 is moved with the second front-wall portion 37 toward the top of the hold 3. Due to the inclined profile of the second front-wall portion 37, the inclined freight container 7 can be conveyed further into the hold 3 than would be the case if the top wall 27 were to extend as far as the frontmost end of the freight container 7 in the plane thereof.

Thus, in the case of the freight container 7 according to the first exemplary embodiment, it is possible, in a hold 3, with a predefined height, for the top wall 27 to be arranged, remote from the frontmost end of the freight container 7, at a greater distance from the bearing surface 11 than would be the case if the top wall 27 were to extend in a plane as far as the frontmost end. It is thus possible for the receiving volume of the freight container 7 according to the invention to be increased in comparison with a conventional design.

Figure 3:
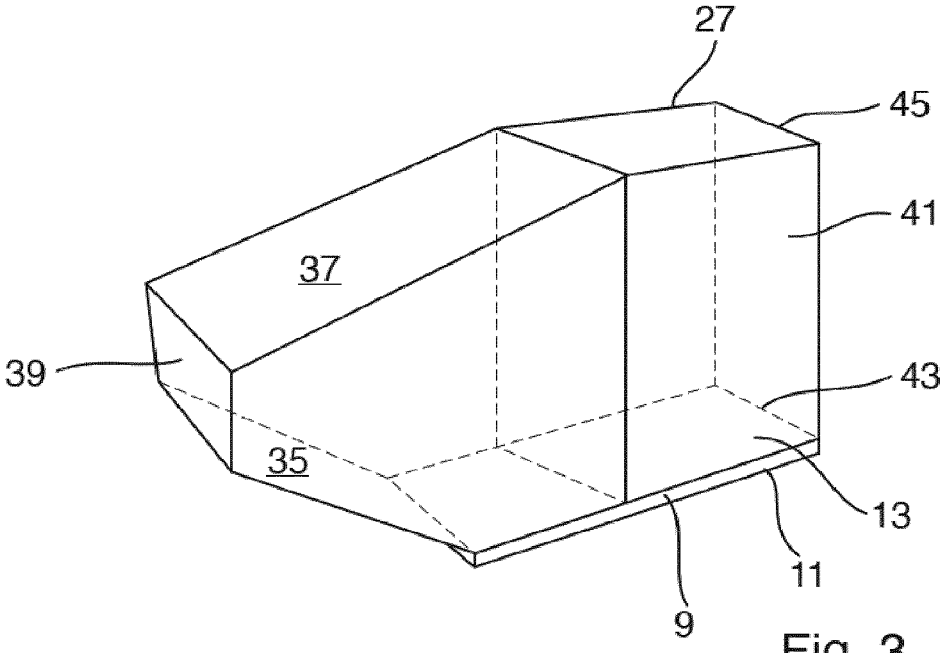
FIG. 3 shows a second exemplary embodiment of a freight container according to the invention in a perspective illustration.

FIG. 3 shows an alternative embodiment of a freight container 7 according to the invention, which differs from that from FIG. 2, however, only in that the freight container 7 is configured in such a way that the rear wall 41 extends from the fourth edge 43 of the base surface 13 toward the rear edge 45 of the top wall 27 at an angle of 90°. The rear wall 41 thus extends in a plane from the fourth edge 43 to the rear edge of the top wall 27.

Such a configuration is advantageous if the hold 3 of a vehicle 1 is of such a width that two freight containers 7 can be received next to one another "back-to-back" in the hold 3 of the aircraft 1. Then, in this configuration, as little stowage space as possible is wasted. Otherwise, the advantages with regard to the enlargement of the spacing between top wall 27 and bottom element 9 are achieved with the second exemplary embodiment too.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

1 Aircraft
3 Hold

5 Loading hatch
7 Freight container
9 Bottom element
11 Bearing surface
13 Base surface
15 Receiving space
17 First edge
19 Second edge
21 First side wall
23 Second side wall
25 Edge
27 Top wall
29 Front wall
31 Third edge
33 Front edge
35 First front-wall portion
37 Second front-wall portion
39 Third front-wall portion
41 Rear wall
43 Fourth edge
45 Rear edge
47 First rear-wall portion
49 Second rear-wall portion
51 Eyelet
W1 First angle
W2 Second angle
W3 Third angle
W4 Fourth angle

The invention claimed is:

1. A freight container configured to be received in a hold of an aircraft, comprising a bottom element which has a bearing surface which is configured to bear on a bottom surface of a hold of an aircraft, wherein the bottom element has a rectangular base surface which is arranged on a side of the bottom element which faces away from the bearing surface, a first and a second side wall which extend away from mutually opposite first and second edges of the base surface, wherein the first and second side walls extend in planes which are spaced apart from one another, a top wall, positioned between edges, remote from the first and second edges, of the first and second side walls, the top wall extending parallel to the bearing surface, a front wall extending between the first and second side walls from a third edge of the base surface to a front edge of the top wall, wherein the third edge connects the first and second edges to one another, wherein the third edge, as seen in the plane of the bearing surface, and the front edge, as seen in the plane of the top wall, face in the same direction, wherein the front wall has a first front-wall portion which extends from the third edge of the base surface at a first angle of at least 90° to the bearing surface between the first and second side walls, wherein the front wall has a second front-wall portion which extends from the front edge of the top wall at a second angle of less than 180° and greater than 90° to the top wall, a rear wall extending between the first and second side walls from a fourth edge of the base surface to a rear edge of the top wall, wherein the fourth edge connects the first and second edges to one another, and wherein the fourth edge, as seen in the plane of the base surface, and the rear edge, as seen in the plane of the top wall, face in the same direction, wherein a plane intersecting the front edge of the top wall forms a 90° angle with the top wall and intersects the base surface inwardly from the third edge of the base surface in a direction towards the fourth edge of the base surface, such that the second front wall portion has a length greater than the first front wall portion.

2. The freight container as claimed in claim 1, wherein the base surface extends parallel to the bearing surface.

3. The freight container as claimed in claim 1, wherein the planes of the first and second side extend parallel to one another and perpendicularly to the bearing surface.

4. The freight container as claimed in claim 1, wherein the first angle is greater than 90° and is preferably at least 135°.

5. The freight container as claimed in claim 1, wherein, between the first front-wall portion and the second front-wall portion, a third front-wall portion connects the first front-wall portion to the second front-wall portion.

6. The freight container as claimed in claim 5, wherein the third front-wall portion extends at an angle of 90° to the bearing surface.

7. The freight container as claimed in claim 1, wherein the rear wall has a first rear-wall portion which extends from a fourth edge of the base surface at a third angle of greater than 90° to the bearing surface between the first and second side walls.

8. The freight container as claimed in claim 7, wherein the third angle is at least 135°.

9. The freight container as claimed in claim 7, wherein the rear wall has a second rear-wall portion which extends from the rear edge of the top wall at a fourth angle of less than 180° to the top wall.

10. The freight container as claimed in claim 9, wherein the second rear-wall portion extends from the rear edge of the top wall at the fourth angle of 90° to the top wall.

11. The freight container as claimed in claim 9, wherein the first and second rear-wall portions are connected directly to one another.

12. The freight container as claimed in claim 1, wherein the rear wall extends from the fourth edge of the base surface toward the rear edge of the top wall at an angle of 90°.

13. The freight container as claimed in claim 1, wherein, along an edge of at least one of the first or the second side wall, fastening devices are provided for connection to freight-compartment fastening elements.

14. The freight container as claimed in claim 13, wherein the rear wall has a first rear-wall portion which extends from a fourth edge of the base surface at a third angle of greater than 90° to the bearing surface between the first and second side walls, and wherein the fastening devices are provided on an edge between at least one of the first or the second side wall and the first front-wall portion and on an edge between at least one of the first or the second side wall and the first rear-wall portion.

* * * * *